United States Patent [19]

Quinlan

[11] 4,071,746

[45] Jan. 31, 1978

[54] ALKYLBENZYL PYRIDINIUM COMPOUNDS AND USES

[75] Inventor: Patrick M. Quinlan, Webster Groves, Mo.

[73] Assignee: Petrolite Corporation, St. Louis, Mo.

[21] Appl. No.: 698,586

[22] Filed: June 22, 1976

Related U.S. Application Data

[62] Division of Ser. No. 232,208, March 6, 1972, abandoned.

[51] Int. Cl.[2] ..... C23F 11/14

[52] U.S. Cl. ..... 252/392; 21/2.7 R; 252/390; 252/394; 260/290 R

[58] Field of Search ..... 252/392, 390, 394; 21/2.7 R; 260/290 R

[56] References Cited

U.S. PATENT DOCUMENTS 3,288,555 11/1966 Napier et al. ..... 252/390

*Primary Examiner*—Benjamin R. Padgett
*Assistant Examiner*—Irwin Gluck
*Attorney, Agent, or Firm*—Sidney B. Ring; Hyman F. Glass

[57] ABSTRACT

Alkylbenzyl pyridinium compounds, for example of the general formula

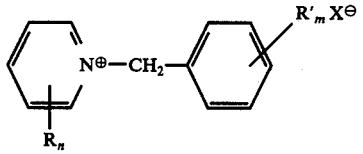

where R is a hydrocarbon group, preferably alkyl, occurring *n* times in the ring such as 1–3, but preferably 1 or 2; and R′ is a hydrocarbon group, preferably alkyl, occurring *m* times, such as 1–3, but preferably 1, and X⁻ is an anion, preferably halogen. These compositions are employed as corrosion inhibitors, preferably in acid systems. These are preferably employed as corrosion inhibitors with surfactants, and most preferably with surfactants and alcohols.

14 Claims, No Drawings

ALKYLBENZYL PYRIDINIUM COMPOUNDS AND USES

This is a Division of Application Ser. No. 232,208, filed Mar. 6, 1972, by Patrick M. Quinlan, and now abandoned.

Certain systems subject to corrosion are often difficult to treat. These systems include acidic systems such as the pickling of ferrous metals, the treatment of calcareous earth formations, etc., or other systems where sulfuric, hydrochloric, nitric, phosphoric, acetic, etc., acids or equivalent systems of acid salts such as sulfates, chlorides, etc., are employed.

In patent application Ser. No. 158,613, filed June 30, 1971, there is disclosed and claimed certain quaternary nitrogen heterocyclics and uses thereof, particularly as corrosion inhibitors.

I have now discovered that a class of pyridinium compounds are unexpectedly effective as corrosion inhibitors.

I have further discovered that the effectiveness of these pyridinium compounds can be further enhanced by the presence of surfactants, particularly non-ionic surfactants such as oxyalkylated surfactants.

I have further discovered that the effectiveness of the pyridinium-surfactant system can be further improved by the presence of hydroxy compounds, such as for example alkanols, glycols, alkenols, alkynols, mixtures thereof, etc.

The pyridines employed herein in preparing the pyridinium compounds are of the general formula

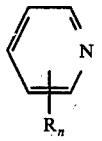

where the R is a substituted group, such as hydrocarbon, but preferably alkyl occurring in the ring *n* number of times, such as 1–3, but preferably 1 to 2 times; for example 2-, 3-, or 4-picoline, etc., 2,3-, 2,6-, 2,4-lutidine, etc., collidines, etc., higher substituted pyridines such as propyl, butyl, pentyl, hexyl, heptyl, octyl, nonyl, decyl, etc., substituted pyridines, such as 2-amyl pyridine, 4-amyl pyridine, 2-hexyl-pyridine, 4-propyl pyridine, etc., the amyl-methyl pyridines, the hexylmethyl-ethyl pyridines, etc.

Other pyridines include commercially available products in which such compounds are present such as in denaturing pyridine, coal tar distillates, and the like, for example Alkyl Pyridine-R (Union Carbide) which is a mixture of high boiling alkyl pyridines with an equivalent weight of 170. Pyridine Base HAP (Reilly Tar and Chemical Company) which is a mixture of high boiling alkyl pyridines with an equivalent weight of 200. Pyridine Base LAP (Reilly Tar and Chemical) which is a mixture of alkyl pyridines with an equivalent weight of 130.

The substituted benzyl groups employed in preparing the composition of this invention are of the general formula

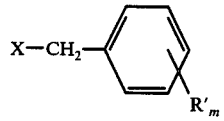

where X is an anion, preferably a halide, and R′ is a substituted group, such as hydrocarbon, and preferably alkyl occurring *m* times in the benzene ring, such as 1–3 times, but preferably 1 time; R′ is, for example, methyl, ethyl, propyl, butyl, pentyl, hexyl, nonyl, decyl, undecyl, dodecyl, tridecyl, tetradecyl, pentadecyl, hexadecyl, heptadecyl, octadecyl, etc., in linear, branched, etc. configuration. Preferably the sum of the carbons in the substituted groups are at least 6, such as 6–18, but preferably 10–14, and most preferably 12. The preferred alkyl group is dodecyl.

The substituted benzyl halide is reacted with the substituted pyridine under quaternary forming conditions according to the general formula

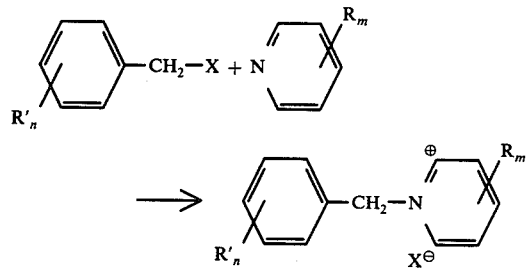

This type of reaction is conventional.

The following examples are presented for purposes of illustration and not of limitation.

The crude pyridine bases employed were the following: "Alkyl Pyridine R" from Union Carbide Company. This material is described as a mixture of high boiling alkyl pyridines with an equivalent weight of 170. "Pyridine Base HAP" from Reilly Tar and Chemical Company. This material is described as a mixture of high boiling alkyl pyridines with an equivalent weight of 200.

These two materials were quaternized in the following manner:

EXAMPLE 1

A mixture of 170 g. of Alkyl Pyridine R, 292 g. of dodecyl benzyl chloride and 462 g. of water was stirred and heated at reflux temperatures for a period of 16 hours.

EXAMPLE 2

A mixture of 200 g. of Pyridine Base HAP, 292 g. of dodecyl benzyl chloride and 492 g. of water was stirred and heated at reflux temperatures for a period of 12 hours.

EXAMPLE 3

A mixture of 107 g. of Koppers*16–20 grade tar base, 292 g. of dodecyl benzyl chloride and 399 g. of water was stirred and heated together at reflux temperatures for a period of 24 hours.

*16–20 grade tar base consists of wide boiling fractions of lutidines and collidines distilling between 160°–200° C.

Other specific examples of pyridinium compounds prepared by similar techniques are presented in the following table.

Table I

| Ex. | Alkyl pyridine base | Substituted benzyl halide |
|---|---|---|
| 4. | Pyridine Base LAP | dodecyl benzyl chloride |
| 5. | 4-iso-propylpyridine | " |
| 6. | 4-picoline | " |
| 7. | 2,4-lutidine | " |
| 8. | 2-methyl-5-ethyl pyridine | " |
| 9. | 4-amyl pyridine | " |
| 10. | 2-hexyl pyridine | " |

USE AS PICKLING INHIBITORS

This phase of the invention relates to pickling. More particularly, the invention is directed to a pickling composition and to a method of pickling ferrous metal. The term "ferrous metal" as used herein refers to iron, iron alloys and steel.

To prepare ferrous metal sheet, strip, etc., for subsequent processing, it is frequently desirable to remove oxide coating, formed during manufacturing, from the surface. The presence of oxide coating, referred to as "scale" is objectionable when the material is to undergo subsequent processing. Thus, for example, oxide scale must be removed and a clean surface provided if satisfactory results are to be obtained from hot rolled sheet and strip in any operation involving deformation of the product. Similarly, steel prepared for drawing must possess a clean surface and removal of the oxide scale therefrom is essential since the scale tends to shorten drawing-die life as well as destroy the surface smoothness of the finished product. Oxide removal from sheet or strip is also necessary prior to coating operations to permit proper alloying or adherence of the coating to the ferrous metal strip or sheet. Prior to cold reduction, it is necessary that the oxide formed during hot rolling be completely removed to preclude surface irregularities and enable uniform reduction of the work. The chemical process used to remove oxide from metal surfaces is referred to as "pickling." Typical pickling processes involve the use of aqueous acid solutions, usually inorganic acids, into which the metal article is immersed. The acid solution reacts with the oxides to form water and a salt of the acid. A common problem in this process is "overpickling" which is a condition resulting when the ferrous metal remains in the pickling solution after the oxide scale is removed from the surface and the pickling solution reacts with the ferrous base metal. An additional difficulty in pickling results from the liberated hydrogen being absorbed by the base metal and causing hydrogen embrittlement. To overcome the aforementioned problems in pickling, it has been customary to add corrosion inhibitors to the pickling solution.

The present invention avoids the above-described problems in pickling ferrous metal articles and provides a pickling composition which minimizes corrosion, overpickling and hydrogen embrittlement. Thus the pickling inhibitors described herein not only prevent excessive dissolution of the ferrous base metal, but effectively limit the amount of hydrogen absorption thereby during pickling. According to the invention, a pickling composition for ferrous metal is provided which comprises a pickling acid such as sulfuric or hydrochloric acid and a small but effective amount of the alkylbenzyl pyridinium compounds of this invention, for example at least about 5 ppm, such as from about 100 to 10,000 ppm, for example from about 250 to 5,000, but preferably from about 500 to 2,500 ppm.

Ferrous metal articles are pickled by contacting the surface (usually by immersion in the pickling solution) with a pickling composition as described to remove oxide from their surface with minimum dissolution and hydrogen embrittlement thereof and then washing the ferrous metal to remove the pickling composition therefrom.

USE IN ACIDIZING EARTH FORMATIONS

The compositions of this invention can also be used as corrosion inhibitors in acidizing media employed in the treatment of deep wells to reverse the production of petroleum or gas therefrom and more particularly to an improved method of acidizing a calcareous or magnesium oil-bearing formation.

It is well known that production of petroleum or gas from a limestone, dolomite, or other calcareous-magnesian formation can be stimulated by introducing an acid into the producing well and forcing it into the oil or gas bearing formation. The treating acid, commonly a mineral acid such as HCl, is capable of forming water soluble salts upon contact with the formation and is effective to increase the permeability thereof and augment the flow of petroleum to the producing well.

Although the substituted benzyl quaternaries are superior to the unsubstituted benzyl quaternaries, the corrosion inhibiting properties of the substituted benzyl quaternaries can be further enhanced by presence of non-ionic surfactants or non-ionic surfactants and hydroxy compounds.

The hydroxy compounds of this invention are alcohol compounds such as alkanols, alkenols, alkynols, glycols, polyols, etc.

Representative examples comprise one or more hydroxylic compounds such as methanol, ethanol, isopropanol, n-propanol, ethylene-glycol, propargyl alcohol, 2-methyl-3 butyn-2-ol, 2,5-dimethyl-3-butyn-2,5-diol, butynediol, 1-hexyn-3-ol, 1-octyn-3-ol, 1-propyn-3-ol, 3-methyl-1-butyn-3-ol.

A preferred commercial hydroxy composition is OW-1 sold by Airco which is proprietary mixture of acetylenic compounds.

Although the substituted benzyl quaternary can be employed alone, it is preferably employed as a mixture, for example, from about 25 to 90% of the benzyl quaternary, such as from about 25 to 80, but preferably from about 30 to 75; from about 10 to 25% of the surfactant, such as from about 10 to 20, but preferably from about 10 to 15; and from about 15 to 75% of the alcohol, such as from about 15 to 50, but preferably from about 15 to 40. In practice, the composition generally contains some water in order to render the composition more fluid.

The surfactant employed in conjunction with the pyridinium compound should be soluble or dispersible in the corrosion inhibiting system. In general it is an oxyalkylated material which is water soluble or dispersible so that it enhances corrosion inhibition.

Any suitable surfactant can be employed. The surfactants which are most usually employed in the practice of this invention are oxyalkylated surfactants or more specifically polyalkylene ether or polyoxyalkylene surfactants. Oxyalkylated surfactants as a class are well known. The possible sub-classes and specific species are legion. The methods employed for the preparation of such oxyalkylated surfactants are also too well known to require much elaboration. Most of these surfactants contain, in at least one place in the molecule and often in several places, an alkanol or a polyglycolether chain. These are most commonly derived by reacting a starting molecule, possessing one or more oxyalkylatable reactive groups, with an alkylene oxide such as ethylene oxide, propylene oxide, butylene oxide, etc. However, they may be obtained by other methods such as shown in U.S. Pat. Nos. 2,588,771 and 2,596,091–3, or by esterification or amidification with an oxyalkylated material, etc. Mixtures of oxides may be used as well as successive additions of the same or different oxides may be employed. Any oxyalkylatable material may be employed. As typical starting materials may be mentioned alkyl phenols, phenolic resins, alcohols, glycols, amines, organic acids, carbohydrates, mercaptans, and partial esters of polybasic acids. In general, the art teaches that, if the starting material is water-soluble, it may be converted into an oil-soluble surfactant by the addition of polypropoxy or polybutoxy chains. If the starting material is oil-soluble, it may be converted into a water soluble product. Subsequent additions of ethoxy units to the water-soluble surfactant by the addition of polyethoxy chains tend to increase the water solubility, while, subsequent additions of high alkoxy chains tend to increase the oil solubility. In general, the final solubility and surfactant properties are a result of a balance between the oil-soluble and water-soluble portions of the molecule.

In the practice of this invention I have found that suitable surfactants may be prepared from a wide variety of starting materials. For instance, if I begin with an oil-soluble material such as a phenol or a long chain fatty alcohol and prepare a series of products by reaction with successive portions of ethylene oxide, I find that the members of the series are successively more water-soluble. Similarly it is possible to start with water or a water-soluble material such as polyethylene glycol and add, successively, portions of propylene oxide. The members of this series will be progressively less water-soluble and more oil-soluble. There will be a preferred range where the materials are useful for the practice of this invention.

In general, the compounds which would be selected are oxyalkylated surfactants of the general formula $$Z[(OA)_nOH]_m$$

wherein Z is the oxyalkylatable material, A is the radical derived from the alkylene oxide which can be, for example, ethylene, propylene, butylene, and the like, $n$ is a number determined by the moles of alkylene oxide reacted, for example 1 to 2000 or more and $m$ is a whole number determined by the number of reactive oxyalkylatable groups. Where only one group is oxyalkylatable as in the case of a monofunctional phenol or alcohol R'OH, then $m=1$. Where Z is water, or a glycol, $m=2$. Where Z is glycerol, $m=3$, etc.

In certain cases, it is advantageous to react alkylene oxides with the oxyalkylatable material in a random fashion so as to form a random copolymer on the oxyalkylene chain, i.e., the $[(OR)_nOH]_m$ chain such as —AABAAABBABABBABBA—. In addition, the alkylene oxides can be reacted in an alternate fashion to form block copolymers on the chain, for example

—BBBAAABBBAAAABBBB— or

BBBBAAACCCAAAABBBB— where A is the unit derived from one alkylene oxide, for example ethylene oxide, and B is the unit derived from a second alkylene oxide, for example propylene oxide, and C is the unit derived from a third alkylene oxide, for example, butylene oxide, etc. Thus, these compounds include terpolymers or higher copolymers polymerized randomly or in a blockwise fashion or many variations or sequential additions.

Thus, $(OR)_n$ in the above formula can be written $-A_aB_bC_c-$ or any variation thereof, wherein $a$, $b$ and $c$ are 0 or a number provided that at least one of them is greater than 0.

It cannot be overemphasized that the nature of the oxyalkylatable starting material used in the preparation of the emulsifier is not critical. Any species of such material can be employed. By proper additions of alkylene oxides, this starting material can be rendered suitable as a surfactant and its suitability can be evaluated by testing in the corrosion system.

REPRESENTATIVE EXAMPLES OF Z

| No. | Z |
|---|---|
| 1 | $RC(=O)-O-$ |
| 2 | 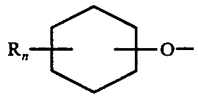 |
| 3 | $R-O-$ |
| 4 | $R-S-$ |
| 5 | $R-C(=O)-NH-$ |
| 6 | $R-C(=O)-N<$ |
| 7 | $R-NH-$ |
| 8 | $RN<$ |
| 9 | Phenol-aldehyde resins. |
| 10 | —O— (Ex: Alkylene oxide block polymers). |
| 11 | 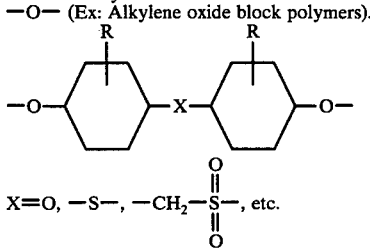 X=O, —S—, $-CH_2-S(=O)_2-$, etc. |
| 12 | $R-S-CH_2C(=O)-O-$ |
| 13 | $RPO_4H$ |
| 14 | $RPO_4=$ |
| 15 | $PO_4=$ |
| 16 | 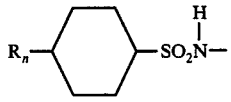 |
| 17 | 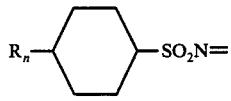 |

-continued

| No. | REPRESENTATIVE EXAMPLES OF Z<br>Z |
|---|---|
| 18 | 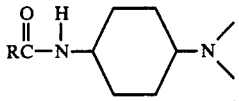 |
| 19 | Polyol-derived (Ex: glycerol, glucose, pentaerithrytol). |
| 20 | Anhydrohexitan or anhydrohexide derived (Spans and Tweens). |
| 21 | Polycarboxylic derived. |
| 22 | $-(CHCH_2-O)_n-$<br>$\vert$<br>$CH_2$<br>amino |

much more of a synergistic corrosion inhibitor effect than other quaternaries derived from the same pyridine base. These quaternaries were blended in similar amounts with a non-ionic surface active agent, OW-1, a mixture of acetylenic compounds and isopropanol. These inhibitor compositions were employed to inhibit 15% hydrochloric acid. The test metal was AISI 1010 mild steel coupons $3\frac{1}{2} \times \frac{7}{8} \times \frac{1}{8}$ inches. 0.2%, by volume, of inhibitor was employed. The tests were run at 200° F for 4 hours. The results of such tests are in the table below where the superiority of the compositions of this invention (A) are clearly evident.

$$\text{Corrosion Rate (lbs/ft}^2\text{/day)} = \frac{\text{Wt. loss coupon (gms)} \times 24}{454 \times \text{hrs. of test} \times \text{coupon surface area in sq. ft.}}$$

Table II

| Example | Composition of Inhibitor (% by weight) | | Corrosion Rate (lbs/ft²/day) |
|---|---|---|---|
| A | 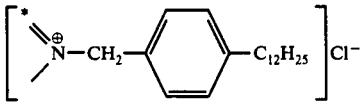 | 30% | 0.055 |
| | OW-1 | 15% | |
| | nonyl phenol condensed with 10 moles of ethylene oxide | 10% | |
| | Isopropanol | 30% | |
| | Water | 15% | |
| B | 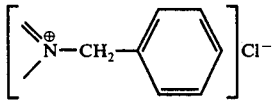 | 30% | 0.338 |
| | OW-1 | 15% | |
| | nonyl phenol + 10 moles EtO | 10% | |
| | Isopropanol | 30% | |
| | Water | 15% | |
| C | 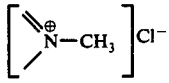 | 30% | 0.181 |
| | OW-1 | 15% | |
| | nonyl phenol + 10 moles EtO | 10% | |
| | Isopropanol | 30% | |
| | Water | 15% | |
| D | 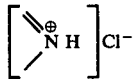 | 30% | 0.238 |
| | OW-1 | 15% | |
| | nonyl phenol + 10 moles EtO | 10% | |
| | Isopropanol | 30% | |
| | Water | 15% | |
| E | Blank | | 9.500 |

* N = Alkyl Pyridine R

Examples of oxyalkylatable materials derived from the above radicals are legion and these, as well as other oxyalkylatable materials, are known to the art. A good source of such oxyalkylatable materials, as well as others, can be found in "Surface Active Agents and Detergents," vols. 1 and 2, by Schwartz et al., Interscience Publishers (vol. 1, 1949, vol. 2, 1958), and the patents and references referred to therein.

The synergistic effects achieved by this invention will be illustrated by the preferred embodiments.

It was found that the quaternary nitrogen salt derived from Alkyl Pyridine R and dodecyl benzyl chloride had In addition it was found that the quaternary nitrogen salt derived from Alkyl Pyridine R and dodecyl benzyl chloride was superior to the other quaternaries derived from the same pyridine base. These inhibitors were used to inhibit 15% hydrochloric acid. The test metal was AISI 1010 mild steel coupons $3\frac{1}{2} \times \frac{7}{8} \times \frac{1}{8}$ inches. 0.2%, by volume, of inhibitor was used. The tests were run at 200° F for 4 hours. The results of this test are in the table below where the superiority of the compositions of this invention (A) are clearly evident.

Table III

| Example | Composition of Inhibitor (% by weight) | | Corrosion Rate (lbs/ft²/day) |
|---|---|---|---|
| A | 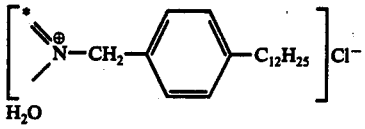 | 50% | 0.710 |
| | $H_2O$ | 50% | |
| B | 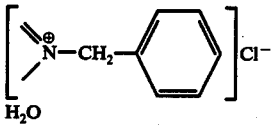 | 50% | 1.15 |
| | $H_2O$ | 50% | |
| C | 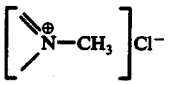 | 50% | 1.90 |
| | $H_2O$ | 50% | |
| D | 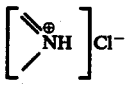 | 50% | 1.78 |
| | $H_2O$ | 50% | |
| E | Blank | | 9.43 |

* N = Alkyl Pyridine R

The following examples are illustrative of this invention. Parts and proportions are by weight.

EXAMPLE 11

| | % by weight |
|---|---|
| Quaternized pyridine base from Example 1 | 30 |
| Acetylenic mixture OW-1 | 15 |
| nonyl phenol condensed with 10 moles ethylene oxide | 10 |
| isopropanol | 15 |
| water | 30 |

EXAMPLE 12

| | % by weight |
|---|---|
| Quaternized pyridine base from Example 2 | 30 |
| OW-1 | 15 |
| nonyl phenol condensed with 10 moles ethylene oxide | 10 |
| isopropanol | 15 |
| water | 30 |

EXAMPLE 13

| | % by weight |
|---|---|
| Quaternized pyridine base from Example 3 | 30 |
| OW-1 | 15 |
| nonyl phenol condensed with 10 moles ethylene oxide | 10 |
| isopropanol | 15 |
| water | 30 |

To avoid repetitive detail, the following table illustrates the compositions of this invention.

Table IV

| Ex. | Quaternized Pyridine Base | Non-Ionic Surface Active Agent | Hydroxylic Compound or Compounds | |
|---|---|---|---|---|
| 14 | From Ex. 1 (30) | nonyl phenol + 15 moles ethylene oxide (10) | OW-1<br>Isopropanol<br>Water | (15)<br>(20)<br>(25) |
| 15 | From Ex. 1 (30) | nonyl phenyl + 10 moles ethylene oxide (10) | Propargyl alcohol<br>Isopropanol<br>Water | (15)<br>(20)<br>(25) |
| 16 | From Ex. 1 (30) | stearyl amine + 23 moles ethylene oxide (10) | OW-1<br>Isopropanol<br>Water | (15)<br>(20)<br>(25) |
| 17 | From Ex. 1 (30) | nonyl phenol + 10 moles ethylene oxide (10) | 1-hexyn-3-ol<br>Methanol<br>Water | (15)<br>(25)<br>(20) |
| 18 | From Ex. 2 (40) | nonyl phenol + 10 moles ethylene oxide (10) | 1-octyn-3-ol<br>Ethanol | (20)<br>(30) |
| 19 | From Ex. 2 (30) | nonyl phenol + 15 moles ethylene oxide (10) | Isopropanol<br>Water | (30)<br>(30) |
| 20 | From Ex. 2 (30) | nonyl phenol + 10 moles ethylene oxide (10) | Isopropanol<br>Water | (30)<br>(30) |
| 21 | From Ex. 2 (30) | stearyl amine + 23 moles ethylene oxide (10) | Isopropanol<br>Water | (30)<br>(30) |
| 22 | From Ex. 2 (50) | dinonyl phenol + 17 moles ethylene oxide (15) | Propargyl alcohol<br>Ethanol | (10)<br>(25) |
| 23 | From Ex. 1 (80) | nonyl phenol + 10 moles ethylene oxide (10) | Isopropanol | (10) |

Table IV-continued

| Ex. | Quaternized Pyridine Base | Non-Ionic Surface Active Agent | Hydroxylic Compound or Compounds | |
|---|---|---|---|---|
| 24 | From Ex. 1 (80) | nonyl phenol + 15 moles ethylene oxide (10) | Isopropanol | (10) |
| 25 | From Ex. 1 (80) | stearyl amine + 23 moles ethylene oxide (10) | Methanol | (10) |

The numbers if ( ) indicate % by weight.

The inhibitor compositions of this invention were employed to inhibit corrosion in 15% hydrochloric acid. The tests were run at 200° F for 4 hours. The test metal was AISI 1010 mild steel coupons $3\frac{1}{2} \times \frac{7}{8} \times \frac{1}{8}$ inches. 0.2% by volume, inhibitor was employed. The results of the test are tabulated in the table below.

| Ex. No. | Corrosion rate (lbs/ft²/day) |
|---|---|
| Blank | 9.234 |
| 11 | 0.062 |
| 13 | 0.068 |
| 14 | 0.116 |
| 15 | 0.137 |
| 16 | 0.080 |
| 20 | 0.135 |
| 1 | 0.710 |
| 2 | 0.365 |
| 4 | 0.391 |

In another test various inhibitor compositions were used to inhibit corrosion in 28% sulfuric acid. The tests were run at 200° F for 4 hours. 1010 mild steel coupons were used. 0.25%, by volume, inhibitor was employed. The results of the test are tabulated below.

| Ex. No. | Corrosion Rate (lbs/ft²/day) |
|---|---|
| 23 | 0.075 |
| 24 | 0.080 |
| 25 | 0.052 |
| 2 | 0.075 |
| Blank | 9.623 |

In yet another test various inhibitor compositions were used to inhibit corrosion in 28% sulfuric acid to which 14 g. of $Fe_2(SO_4)_3$ and 10 g. $FeSO_4 \cdot 74_2$ per liter had been added. The results of the test are tabulated in the table below.

| Ex. No. | Corrosion Rate (lbs/ft²/day) |
|---|---|
| 23 | 0.610 |
| 24 | 0.390 |
| 25 | 0.480 |
| 2 | 0.475 |
| Blank | 9.842 |

In addition to the superiority of alkylbenzyl pyridinium compounds, as corrosion inhibitors with or without surfactants and/or alcohols, it should be noted that the presence of surfactants and/or alcohols also enhances the activity of quaternary ammonium compounds generally including benzyl pyridinium compounds. (Compare the superior data of Table II over Table III.)

I claim:

1. An acid corrosion inhibiting composition comprising 1. substituted benzyl pyridinium compounds having the formula

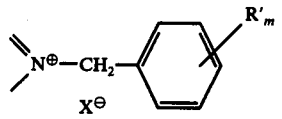

where

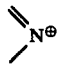

is a pyridinium group, R′ is an alkyl group occurring as a substituent *m* times, and *m* is 1 to 2, X is an anion, said benzyl pyridinium compounds being formed by reacting a mixture of alkyl pyridines with the compound of the formula

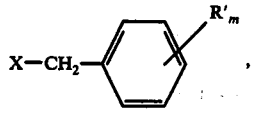

and 2. an oxyalkylated surfactant or an alcohol.

2. The composition of claim 1 where there is present both an oxyalkylated surfactant and an alcohol.

3. The composition of claim 1 where

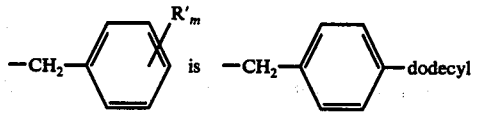

and X is halide.

4. The composition of claim 1 where the oxyalkylated surfactant is a nonyl phenol condensed with 10 moles of ethylene oxide.

5. The composition of claim 1 where the alcohol is isopropanol.

6. The composition of claim 6 where the pyridinium compound is a dodecyl benzyl alkyl substituted pyridinium chloride, the oxyalkylated surfactant is a nonyl phenol condensed with 10 moles of ethylene oxide and the alcohol is isopropanol.

7. The composition of claim 3 where the oxyalkylated surfactant is a nonyl phenol condensed with 10 moles of ethylene oxide and the alcohol is a mixture of propargyl alcohol and isopropanol.

8. A process of inhibiting corrosion of metals in an acid system which comprises adding to said system an acid inhibiting amount of the composition of claim 1.

9. A process of inhibiting corrosion of metals in an acid system which comprises adding to said system an acid inhibiting amount of the composition of claim 2.

10. A process of inhibiting corrosion of metals in an acid system which comprises adding to said system an acid inhibiting amount of the composition of claim 3.

11. A process of inhibiting corrosion of metals in an acid system which comprises adding to said system an acid inhibiting amount of the composition of claim 4.

12. A process of inhibiting corrosion of metals in an acid system which comprises adding to said system an acid inhibiting amount of the composition of claim 5.

13. A process of inhibiting corrosion of metals in an acid system which comprises adding to said system an acid inhibiting amount of the composition of claim 6.

14. A process of inhibiting corrosion of metals in an acid system which comprises adding to said system an acid inhibiting amount of the composition of claim 7.

* * * * *